United States Patent [19]

Boren

[11] Patent Number: 4,891,896

[45] Date of Patent: Jan. 9, 1990

[54] SIMULATED NEON SIGN

[75] Inventor: Vernie A. Boren, Lakewood, Calif.

[73] Assignee: Gulf Development Corporation, Torrance, Calif.

[21] Appl. No.: 232,238

[22] Filed: Aug. 15, 1988

[51] Int. Cl.[4] ..... G09F 13/00

[52] U.S. Cl. ..... 40/541; 40/545; 40/580; 40/552

[58] Field of Search ..... 40/545, 552, 575, 576, 40/577, 559, 560, 570, 618, 580, 541, 540, 564, 442, 443

[56] References Cited

U.S. PATENT DOCUMENTS

| | | | |
|---|---|---|---|
| 770,680 | 9/1904 | De Camps | 40/552 |
| 818,724 | 4/1906 | Williams | 40/576 |
| 1,820,913 | 9/1931 | Kelly et al. | 40/552 |
| 2,032,895 | 3/1936 | Slutsky | 40/552 |
| 2,062,887 | 9/1935 | Karst | 40/132 |
| 2,147,748 | 8/1935 | Miller | 40/133 |
| 2,295,467 | 1/1940 | Haley | 40/125 |
| 2,298,940 | 10/1942 | Hayes | 40/577 |
| 2,299,331 | 11/1939 | Marinone | 40/134 |
| 2,486,859 | 11/1949 | Meijer, nee Kerkhof | 40/134 |
| 2,524,294 | 10/1950 | Marsh | 40/552 |
| 2,584,253 | 2/1952 | Braun, Sr. | 40/618 |
| 2,623,315 | 12/1952 | Owen et al. | 40/552 |
| 2,748,260 | 5/1956 | Nelson | 40/540 |
| 2,769,263 | 11/1956 | Wamser | 40/132 |
| 2,871,598 | 2/1959 | Pawelka | 40/130 |
| 2,928,197 | 12/1958 | Zuckerman | 40/130 |
| 3,510,976 | 3/1968 | Pauline et al. | 40/132 |
| 3,566,525 | 3/1971 | Nassil et al. | 40/552 |
| 3,978,599 | 9/1976 | Berger | 40/132 |
| 3,997,991 | 12/1976 | Hayman-Chaffey | 40/135 |
| 4,316,337 | 3/1980 | Da Costa | 40/564 |
| 4,373,283 | 2/1983 | Swartz | 40/564 |

OTHER PUBLICATIONS

"Gulf's Family of Signs", Gulf Development, Inc., 1974.

Gulf Development, Inc. brochure, "Innovators Not Imitators", undated.

*Primary Examiner*—James T. McCall
*Assistant Examiner*—J. Hakomaki
*Attorney, Agent, or Firm*—Stephen Donovan

[57] ABSTRACT

A simulated neon sign comprises a frame, non-neon internal lighting, and a front plastic panel having an outer face. The outer face of the front plane comprises outwardly projecting indicia and a non-projecting region that is substantially opaque to the internal light. Pigmented translucent coating is applied on the indicia so that light from the internal lighting can pass through the indicia. To simulate the halo effect of a neon light, additional pigmented coating is applied to the non-projecting region of the panel adjacent the indicia. A method for manufacturing the neon sign is also disclosed.

14 Claims, 2 Drawing Sheets

10
12
16
18
20
22
30
32
34
36
38
40
42
44
46
48
50
60
61
2
DON
AK 14
16
18
22
24
26
28
30
48
50
52
54
56
58

SIMULATED NEON SIGN

BACKGROUND

This invention is directed to a simulated neon sign.

Neon signs are currently very popular, partly because they are very attractive and are an excellent way to draw attention to a business. Also, neon signs are part of the recent nostalgia for the "good old days" of the 1950's.

However, neon lighting has significant problems. Neon signs derive their illumination from ionized gases contained in configurated transparent tubing. Currently they are relatively expensive to construct compared to conventional fluorescent signs. Furthermore, neon signs require special electrical service accomplished through transformers.

Other problems with neon lights include that they are fragile, and thus difficult to transport, they have a short life when installed, and are easily broken. This means neon signs are generally impractical to transport to rural areas, and once installed in a rural area, expensive to maintain. Further, when a neon sign breaks, generally the entire sign must be replaced. Neon signs are also difficult to work up into an intricate shape or logo for advertising purposes. Another problem with neon signs is that their transparent tubing is generally not visible in daylight. However, neon signs are so brilliant, they are generally unsuitable for interior use.

Accordingly, there is a need for a sign and device that is as attractive, decorative, and effective for advertising as a neon sign, without the deficiencies of neon signs.

SUMMARY

A simulated neon sign according to the present invention satisfies this need. Such a simulated neon sign comprises a frame, non-neon internal lighting means such as fluorescent or incandescent lighting within the frame, and a special front plastic panel. The front plastic panel, which is held by the frame, has an outer face that comprises outwardly projecting indicia and a non-projecting region. The non-projecting region is substantially opaque to light from the internal lighting means while the indicia are translucent. This is accomplished by applying a first pigmented translucent coating to the indicia so that light from the lighting means can pass through the indicia and pick up color from the pigment. There is an additional pigmented coating on the non-projecting region of the panel adjacent to the indicia. The additional coating is of substantially the same color as the first pigmented coating so that it appears that light from the lighting means passing through the indicia is refracted off the opaque non-refracted region. The purpose of this is to simulate the halo effect of neon lights. This additional coating is preferably applied by air brushing.

The front panel can have on its outer face a substantially transparent glossy coating so that at least the indicia appear glasslike.

To better simulate a neon light, preferably the thickness of the first coating is greater at the center than at the sides of the indicia. This results in the intensity of light passing through the sides of the indicia being substantially the same as at the center.

One advantage of the simulated neon side is that the indicia can be a different color, even in the same word. In this version of the invention, the additional pigmented coating adjacent the indicia is the same color as the color of the first coating on the corresponding indicia.

Generally the front panel is formed of translucent or transparent plastic. In this version of the invention, the non-projecting region has an opaque coating thereon, with the additional pigmented coating being on top of the opaque coating. Typically the opaque coating is black.

An advantage of this invention is that a rear panel substantially identical to the front panel can be provided. The rear and front panels are held by the frame. Thus a two sided simulated neon sign can be fabricated.

The simulated neon sign lends itself to easy manufacture. The plastic panel with its projecting indicia can be formed by vacuum forming a plastic sheet. The indicia are then masked with masking means. An opaque coating is applied to the non-projecting region but not the indicia, the indicia being protected by the masking means. The masking means is then removed from the indicia, the first pigmented translucent coating is applied to the indicia, and then additional pigmented coating is applied to the non-projecting region over the opaque coating immediately adjacent to the indicia. Generally the first pigmented coating and the additional "halo" coating are applied simultaneously with an air brush.

DRAWINGS

These and other features, aspects, and advantages of the present invention will become better understood with reference to the following description, appended claims, and accompanying drawings where:

DESCRIPTION

Figure 1:
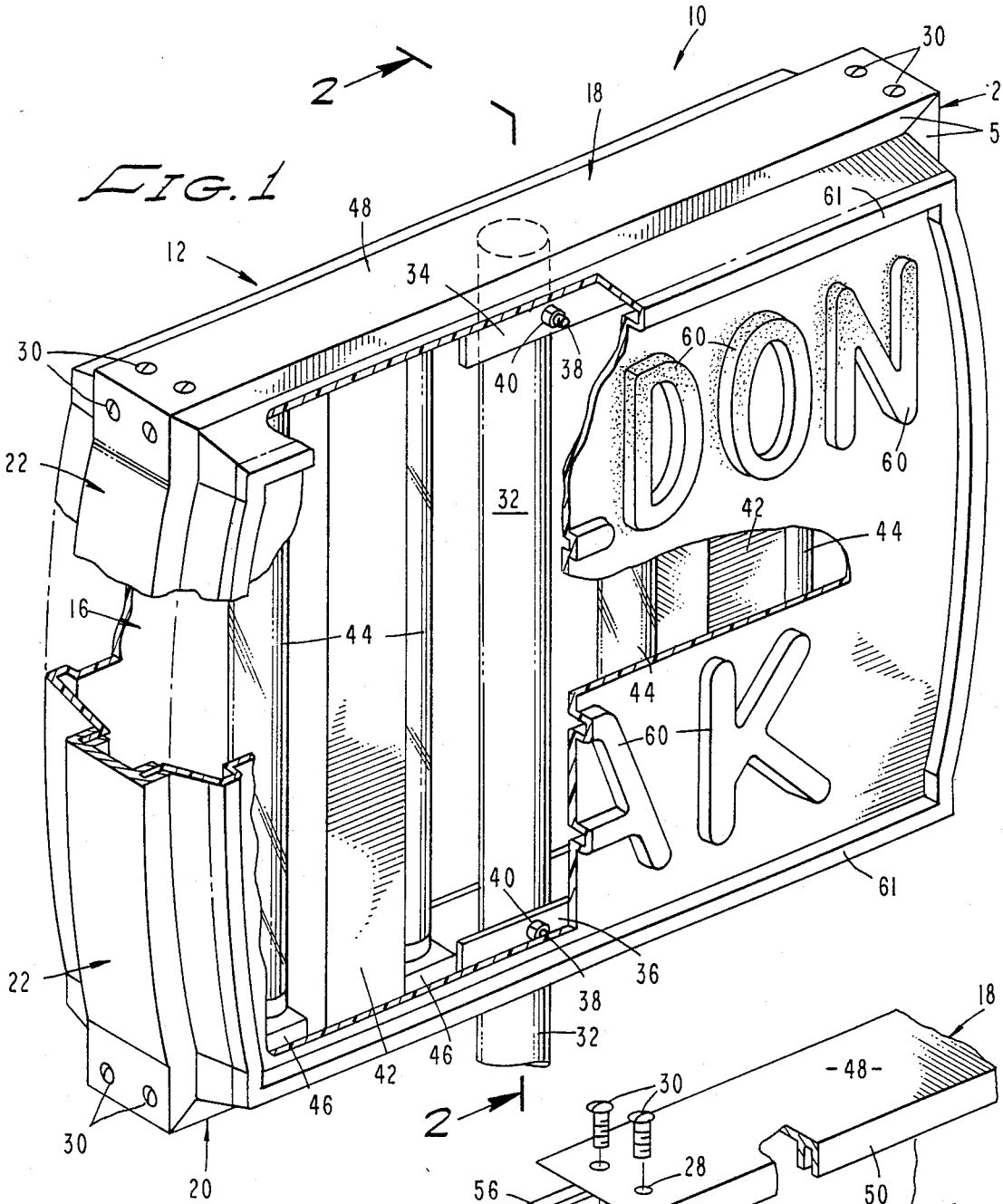
FIG. 1 is a front perspective view, partially broken away, of a simulated neon sign according to the present invention.
Figure 5:
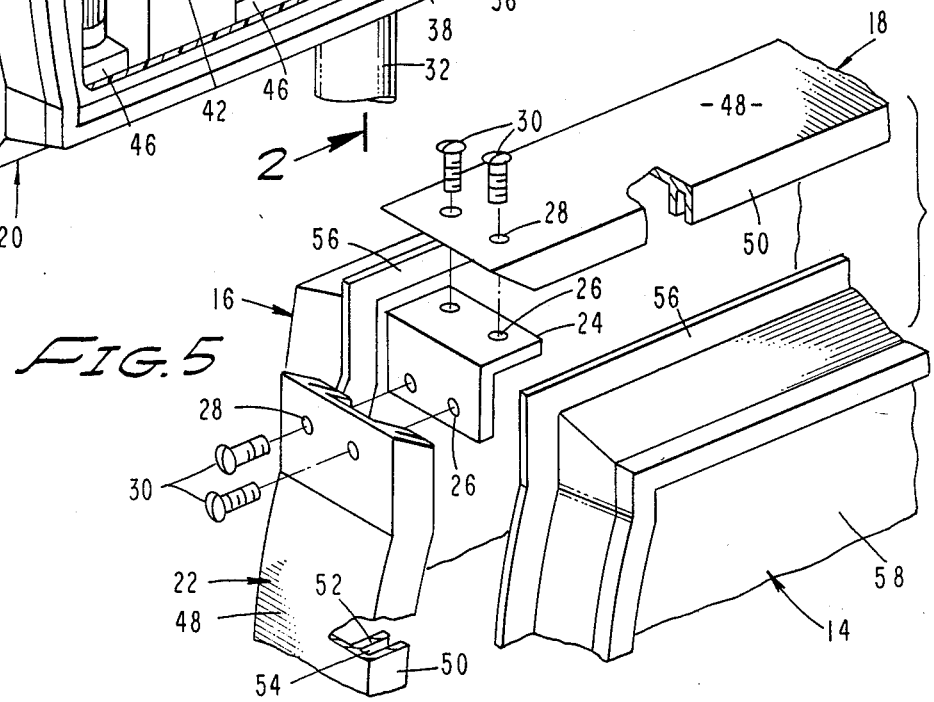
FIG. 5 is an exploded perspective view of a portion of a corner of the sign of FIG. 1.
Figure 2:
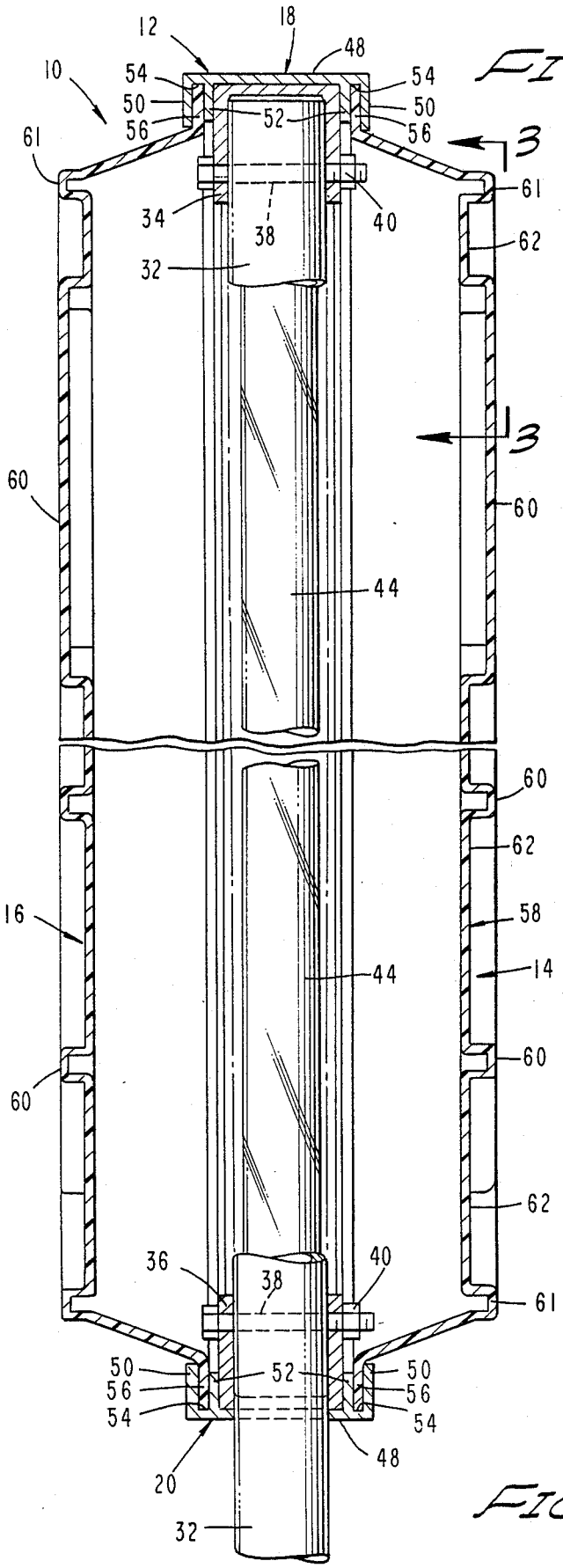
FIG. 2 is a vertical sectional view of the neon sign of FIG. 1 taken on line 2—2 in FIG. 1.

With reference to the figures, a simulated neon sign 10 according to the present invention has a box-like in configuration. It comprises a frame 12 that retains a front plastic panel 14 and a rear plastic panel 16. The frame 12 is conventional, forming the top, bottom, and sides of the box, and includes a top member 18, an opposed bottom member 20, and opposed side members 22. The frame 12 can be configured to provide a sign of substantially any shape and decorative appearance. For example, as shown in the figures, the sidewall members 22 can be curved.

The frame 12 is assembled together by means of a right angled bracket 24 at each corner provided with threaded holes 26 for mating with corresponding holes 28 in the frame elements and adapted to receive a threaded fastener such as a screw 30. The thread in the holes 26 can either be machined or provided by a threaded insert.

The sign 10 can be designed to be mounted on a flat surface, or can be supported by a post 32. The post 32 is attached to the frame 12 by means of top 34 and bottom channels 36 secured to the inside of the top element 18 and bottom element 20 of the frame 12, respectively. The post 32 is held to the channels 34 and 36 by means of a pair of threaded bolts 38 that extend through a hole in the post and mating holes in each channel. Each bolt is held in place by means of a nut 40.

To provide lighting, an electric wire housing 42 is secured inside the frame 12. Connected to the housing are non-neon internal lighting means such as a plurality of fluorescent bulbs 44 mounted in appropriate electrical fixtures 46. Alternatively, and less preferred, incandescent lighting can be used. The preferred lighting is 60 watt fluorescent bulbs, cool white, having a high energy output. Although not shown, service wiring, typically 12 gauge solid wire, can extend through the bottom section 20 of the frame and into the electrical wire housing 42.

Figure 4:
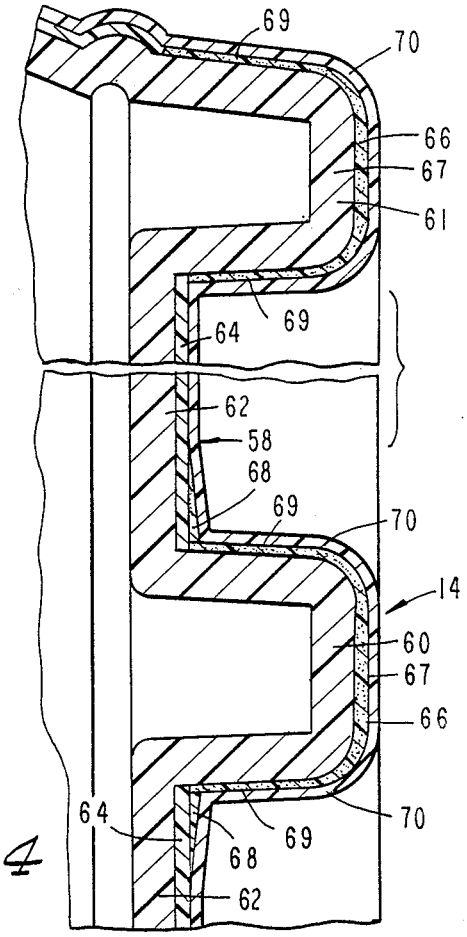
FIG. 4 is a vertical sectional view of a portion of the front panel of the sign of FIG. 1 taken on line 4—4 in FIG. 3.

As best shown in FIG. 4, each of the frame members 18, 20, and 22 is shaped like a U-channel comprising a central web 48 with two outer flanges 50. Inwardly from each outer flange 50 is an inner flange 52, the outer 50 and inner 52 flanges forming a relatively narrow channel 54 adapted to receive an outer rim or border 56 of the front panel 14 and rear panel 16. Both panels include this outer peripheral rim 56. It is by means of the cooperation between the rims 56 and the channels 54 that the plastic panels 14 and 16 are held in place by the frame 12.

The frame 12 can be made of any suitable material such as being formed from extruded aluminum (6063 alloy) that has been anodized a bronze color. The frame 12 can also be made of a rigid material such as ABS (acrylonitrilebutadiene-styrene) plastic. The corner brackets 24, top channel 34, and bottom channel 36 can be made of ⅛ inch structural steel. The height of the channel 54 for receiving the rim 56 can be on the order of about 1 inch.

The construction of the frame 12 and the means by which the frame 12 holds the front and rear panels is conventional. The novelty of the present invention resides in the construction of the panels themselves, which will now be described.

Figure 3:
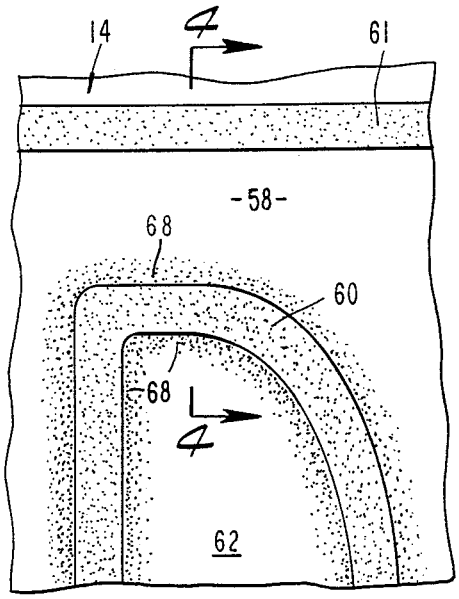
FIG. 3 is a sectional view of a portion of the front panel of the sign of FIG. 1 taken on line 3—3 in FIG. 2.

With reference to the figures, and in particular FIGS. 3 and 4, both the front panel 14 and the rear panel 16 are fabricated of a plastic material, generally vacuum formed, and comprise the rim 56 as well as an outer face 58. The panels are formed of a translucent or transparent plastic so that light from the lighting source 44 can shine therethrough. The outer face 58 comprises outwardly projecting indicia 60. By the term "indicia", there is meant all types of signs, symbols, letters, numbers, logos, and the like that typically appear on signs, and also includes decorative features such as the decorative border 61 around the periphery of the front or outer face 58 of the front panel 14. The indicia on the front and back panels can be different or the same. Alternatively, the sign need not have a back panel with any indicia; the back panel can merely be a blank piece of sheet metal to provide a one-sided sign.

The sign panels, in addition to the projecting indicia, have non-projecting regions 62 around the indicia. As best seen in FIG. 4, there is an opaque coating 64, generally black, on the non-projecting regions 62 of the panels to prevent light from passing from inside the sign and through the panels.

On top of the indicia 60 there is a first pigmented translucent coating 66. This coating 66 is sufficiently translucent that light passes through the coating and becomes colored by the pigment. The first coating 66 is sufficiently thick that the pigment colors the light passing therethrough. Preferably the thickness of the first coating 66 is greater at the center 67 than at the sides 69 of the indicia so that the intensity of light passing through the sides of the indicia is substantially the same as at the center. This helps better simulate a neon light effect in that neon lights generally radiate light equally in all directions. With a typical sign, there is a tendency for light to radiate preferentially normal to the plane of the front panel due to the positioning of the internal lighting. By varying the thickness of the first translucent coating in this way, this tendency is offset to better simulate the appearance of a neon light.

To further simulate the appearance of a neon light, additional pigmented coating 68 is applied to the non-projecting region 62 of the panel adjacent to indicia 60 on top of the opaque coating 64. For example, with reference to FIG. 3, the "dots" immediately adjacent the "D" represent this additional coating 68. This additional coating 68 is substantially the same color as the adjacent first pigmented coating 66. The result of this is that it appears that light from the fluorescent light 44 passing through the indicia 60 is reflected off the opaque non-projecting region 62 to achieve the halo effect of neon lights. This additional pigmented coating 68 can be air brushed into place.

Preferably the entire visible outer surface 58 of the panels is provided with a substantially transparent glossy coating 70, including over the first translucent coating 66, the additional pigmented coating 68, and the opaque coating 64. This makes it appear that the indicia 60, and for that matter the entire front panel, appears glass-like, thereby heightening the simulated appearance of a neon light.

The front and rear panels can be manufactured by vacuum forming a plastic sheet to form a plastic panel having an outer face with the outwardly projecting indicia 60 and the non-projecting regions 62. Then the indicia 60 can be masked with masking means such as masking tape. The opaque coating 64 is then applied to the non-projecting region and not the indicia 60, the indicia 60 being protected by the mask. Then the mask is removed from the indicia 60 and the first pigmented translucent coating 66 is applied to the indicia 60. This could be accomplished with an air brush. Then additional pigmented coating 68 is applied to the non-projecting region over the opaque coating immediately adjacent to the indicia. The color of the additional coating 68 is substantially the same as the color of the coating 66 on the corresponding indicia. In the event that different colors are used for different indicia, then different colors need to be used for the additional pigmented coating corresponding to the color of the adjacent indicia. In other words, with reference to FIG. 1, if the "N" is blue and the "K" is red, then the additional coating 68 adjacent the "N" also needs to be blue and the additional coating adjacent to "K" needs to be red. It should be noted that the pigment applied in the non-projecting region adjacent the letters is not a continuous coating, but is splattered in places such as by air brushing.

In another step, the substantially transparent glossy overcoat 70 is applied over the entire face of the front panel.

The plastic material used for vacuum forming the front and back panels can be a thermoplastic polycarbonate resin, and typically is 0.1 mil thick, white, Lexan (trademark) polycarbonate from General Electric.

The coatings used on the panels need to be compatible with the material of the panel. Typically all three coatings, the opaque coating, the pigmented coating, and the glossy coating are formed with an acrylic laquer. The black coating has black pigmentation, and the translucent colored coating has appropriate colored pigments in a concentration sufficient to color the indicia but still allow light to pass from inside the sign to the outside. The clear glossy coating has substantially no pigmentation.

Acrylic laquers generally are a solution blend in appropriate solvents of a plasticizer and a co-polymer mainly composed of methylmethacrylate. Among the solvents that can be used are ethoxyethanol, N-butanol, xylol, ethyl alcohol, and aliphatic hydrocarbons.

Suitable acrylic lacquers include the Lacryl (trademark) 400 and 800 series acrylic sign paints available from Spraylat Corp. of Mount Vernon, New York. A suitable clear spray is available from Spraylat under the tradename GF Clear Spray.

The masking material can be a conventional sprayable, strippable coating formulated for use as a mask during the painting of plastic signs. Such a masking material is also available from Spraylat Corporation under the catalogue number W-807-2. This material is a polymer dispersed in water, tinted blue and translucent, containing 36% by weight non-volatiles, having a tensile strength of at least 2100 psi and elongation of 200%, and a viscosity of 85±5K rebs Units.

A sign according to the present invention has significant advantages. It provides a surprisingly realistic simulation of neon lighting, while at the same time overcoming many of the problems associated with neon lighting. It is relatively inexpensive to construct and does not require special electrical service. It is less fragile than neon lighting, relatively easy to transport, and has a long life when installed. It is particularly suitable for rural regions where transportation and repairs can be difficult to obtain. It can be fabricated in practically any shape and into any logo design. The sign is visible during bright daylight, but is not so brilliant as to preclude its indoor use. Signs according to the present invention are attractive, decorative, and effective for advertising.

Although the present invention has been described in considerable detail with reference to certain preferred versions thereof, other versions are possible. Therefore the spirit and scope of the appended claims should not be limited to the description of the preferred versions contained herein.

What is claimed is:

1. A simulated neon sign comprising:
(a) a frame;
(b) non-neon internal lighting means within the frame;
(c) a front plastic panel formed of a light transmitting plastic held by the frame and having an outer face, the outer face comprising outwardly projecting indicia and a non-projecting region, the non-projecting region being substantially opaque to light from the internal lighting means;
(d) a first pigmented translucent coating on the indicia so that light from the lighting means can pass through the indicia; and
(e) additional pigmented coating on the non-projecting region of the panel adjacent to the indicia, the additional coating being of substantially the same color as the first pigmented coating so that it appears that light from the lighting means passing through the indicia is reflected off the opaque non-projecting region to achieve the halo effect of neon lights; wherein the thickness of the first coating is greater at the center than at the sides of the indicia so that the intensity of light through the sides of the indicia is substantially the same as at the center.

2. The sign of claim 1 including a substantially transparent glossy coating over substantially the entire outer face of the front panel, including over the translucent coating and the additional pigmented coating, so that at least the indicia appear glass-like.

3. The sign of claim 1 wherein the front panel has indicia of different colors, and wherein the additional pigmented coating adjacent indicia is the same color as the color of the first coating on the corresponding indicia.

4. The sign of claim 1 wherein the non-projecting region has an opaque coating thereon, the additional pigmented coating being on top of the opaque coating.

5. The sign of claim 4 in which the opaque coating is black.

6. The sign of claim 1 wherein the lighting means is fluorescent or incandescent.

7. A simulated neon sign comprising:
(a) a frame;
(b) non-neon internal lighting means within the frame; and
(c) front and a rear plastic panels, both panels formed of light transmitting plastic, held by the frame with the internal light therebetween, each plastic panel comprising:
(i) an outer face having outwardly projecting indicia and a non-projecting region, the non-projecting region being substantially opaque to light from the internal lighting means;
(ii) a first pigmented translucent coating on the indicia so that light from the lighting means can pass through the indicia; and
(iii) additional pigmented coating on the non-projecting region of the panel adjacent to the indicia, the additional coating being of substantially the same color as the first pigmented coating so that it appears that light from the lighting means passing through the indicia is reflected off the opaque non-projected region to achieve the halo effect of neon lights; wherein the thickness of the first coating is greater at the center than at the sides of the indicia so that the intensity of light through the sides of the indicia is substantially the same as at the center.

8. The sign of claim 7 including a substantially transparent glossy coating over substantially the entire outer face of both panels, including over the translucent coating and the additional pigmented coating, so that at least the indicia appear glass-like.

9. The sign of claim 7 wherein the non-projecting region has an opaque coating thereon, the additional pigmented coating being on top of the opaque coating.

10. A method for making a plastic panel for a simulated neon sign comprising the steps of:
(a) vacuum forming a light transmitting plastic sheet to form a plastic panel having an outer face with outwardly projecting indicia thereon and a non-projecting region thereon;
(b) masking the indicia with masking means;

(c) applying an opaque coating to the non-projecting region and not the indicia, the indicia being protected by the masking means;

(d) removing the masking means from the indicia;

(e) applying a first pigmented translucent coating to the indicia wherein the thickness of the first coating is greater at the center than at the sides of the indicia so that the intensity of light through the sides of the indicia is substantially the same as at the center; and (f) applying additional pigmented coating to the non-projecting region over the opaque coating immediately adjacent to the indicia, the color of the additional coating being substantially the same as the color of the first coating on the corresponding indicia.

11. The method of claim 10 including the additional step of applying a substantially transparent glossy overcoat over substantially the entire face of the front panel, the overcoat being on top of the first pigmented coating, the opaque coating, and the additional pigmented coating.

12. The method of claim 10 wherein the step of applying additional pigmented coating comprises air brushing the additional pigmented coating.

13. The method of claim 10 wherein the step of masking the indicia comprises the steps of (i) applying masking means to substantially the entire outer face of the plastic panel, and (ii) removing the masking means except on the indicia.

14. A simulated neon sign comprising:

(a) a frame;

(b) internal fluorescent or incandescent lighting within the frame;

(c) a light emitting sheet of plastic vacuum formed to form a front plastic panel having an outer face comprising outwardly projecting indicia and a non-projecting region, the panel being supported by the frame;

(d) an opaque coating on the non-projecting region, the opaque coating being substantially opaque to the light from the internal lighting;

(e) a first pigmented translucent coating on the indicia that is thicker at the center than at the sides of the indicia so that the intensity of light passing through the sides is substantially the same as the intensity of the light passing through the center of the indicia;

(f) additional pigmented coating air brushed onto the non-projecting region of the panel adjacent to the indicia, the additional coating being on top of the opaque coating, the additional coating being of substantially the same color as the first pigmented coating so that it appears that light from the lighting means passing through the indicia is reflected off the opaque non-projecting region to achieve the halo effect of neon lights; and (g) a substantially transparent glossy coating over substantially the entire outer surface of the front panel, including over the translucent coating, the additional pigmented coating, and the opaque coating, so that at least the indicia appear glass-like.

* * * * *